US010624445B2

(12) United States Patent
Park

(10) Patent No.: US 10,624,445 B2
(45) Date of Patent: Apr. 21, 2020

(54) MULTIPLEX BRUSH

(71) Applicant: Tae-Jong Park, Buena Park, CA (US)

(72) Inventor: Tae-Jong Park, Buena Park, CA (US)

(73) Assignee: Turbo Ion, Inc., Buena Park, CA (US)

( * ) Notice: Subject to any disclaimer, the term of this patent is extended or adjusted under 35 U.S.C. 154(b) by 47 days.

(21) Appl. No.: 16/059,819

(22) Filed: Aug. 9, 2018

(65) Prior Publication Data

US 2019/0008268 A1 Jan. 10, 2019

(30) Foreign Application Priority Data

Oct. 19, 2016 (KR) ..... 10-2016-0136019

(51) Int. Cl.

| | |
|---|---|
| ***A46B 9/02*** | (2006.01) |
| ***A46B 9/06*** | (2006.01) |
| ***A46B 5/02*** | (2006.01) |
| ***A46D 1/00*** | (2006.01) |

(52) U.S. Cl.

CPC ..... *A46B 9/06* (2013.01); *A46B 5/021* (2013.01); *A46B 9/025* (2013.01); *A46B 9/026* (2013.01); *A46D 1/0253* (2013.01); *A46B 2200/104* (2013.01)

(58) Field of Classification Search

CPC ..... A46B 9/06; A46B 5/021; A46B 9/025; A46B 9/026; A46D 1/0253

See application file for complete search history.

(56) References Cited

U.S. PATENT DOCUMENTS 6,575,174 B2 * 6/2003 Lee ..... A46B 9/023 132/148
2010/0071715 A1 * 3/2010 Bickford ..... A46B 9/021 132/218

FOREIGN PATENT DOCUMENTS

KR 200440922 Y1 * 7/2008
KR 20150003589 U * 10/2015

* cited by examiner

*Primary Examiner* — Shay Karls
(74) *Attorney, Agent, or Firm* — Clark Hill PLC

(57) ABSTRACT

This invention is in regards to a multiplex brush. The brush is composed of three types of visible bristles, allowing the users to feel more aware of its effectiveness and difference compared to when using single-type bristle brushes. The straight bristles, 1stwavy bristles and 2ndwavy bristles are planted together so the brush would have more grip. This is in regards to a multiplex brush with 1stwavy bristles and 2ndwavy bristles that are different in the degree and number of curves they have so the brush would allow hairs with different thickness and texture can all be styled easily, while maintaining its optimal condition.

6 Claims, 2 Drawing Sheets

MULTIPLEX BRUSH

FIELD OF THE DISCLOSURE

This invention is in regards to a multiplex brush. More specifically, the brush is composed of three types of visible bristles, allowing the users to feel more aware of its effectiveness and difference compared to when using single-type bristle brushes. The straight bristles, $1^{st}$ wavy bristles and $2^{nd}$ wavy bristles are planted together so the brush would have more grip. This is in regards to a multiplex brush with $1^{st}$ wavy bristles and $2^{nd}$ wavy bristles that are different in the degree and number of curves they have so the brush would allow hairs with different thickness and texture can all be styled easily, while maintaining its optimal condition.

BACKGROUND OF THE INVENTION

In general, hairstyle is an important part of beauty, and it is a way to express aesthetical taste when appropriate changes are made according to the time and place, so efforts are being made to produce various hairstyles.

Hair Brush is one of the tools used to produce various hairstyles, and various hairstyles can be produced depending on how the brush is used.

Generally, various types of apparatuses are used for styling the hair. Among the said apparatuses, brushes are the most typical, and paddle brushes and round brushes have been developed and used as they were intended. That is, referring to FIG. 3, conventional round brushes are composed of a cylindrical body with an integral handle at the lower end of the body for holding. Round brushes are divided into brushes with straight comb-teeth inserted into a cylindrical body, and brushes with multiple comb-teeth inserted in to the cylindrical body in a widened form.

However, the BRISTLE of the conventional round type hair brush is consistently made of the same material and straight bristle so, it is not suitable for easy styling of different hair types.

PRIOR ARTS PATENT DOCUMENTS (Patent document 0001) 1. Korea's Registered Utility Model 20-0440922 (Jul. 9, 2008)

(Patent document 0002) 2. Korea's Publicized Utility Model 20-2015-0003589 (Oct. 2, 2015)

SUMMARY OF THE INVENTION

Technical Problem

The invention has been made to overcome the said problems of the prior art. The objective of the invention is to make the brush more aesthetically pleasing by varying the color of each bristle, and to provide the users with the multiplex brush, visibly comprised of three-types of bristles, which vividly yields a better result compared to the existing single-bristle brushes.

Another objective of this invention is to increase the brush's grip on hair by implanting $1^{st}$ wavy bristles, $2^{nd}$ wavy bristles together with the straight bristles, and because the degree of twists and the number of waves of $1^{st}$ wavy bristles and the $2^{nd}$ wavy bristles are different, various types of hair with different thickness and texture can be styled easily and in the best way.

Solution to Problem

To this end, the multiplex brush according to the present invention has a structure in which bristles are inserted into a plurality of insertion holes formed in a cylindrical body. And in each of the insertions holes, the straight bristles, the $1^{st}$ wavy bristles spirally twisted, and the $2^{nd}$ wavy bristles with a larger degree of the twist than the $1^{st}$ wavy bristles are inserted together.

Further, regarding this invention, the multiplex brush, the straight bristles, the $1^{st}$ wavy bristles, and the $2^{nd}$ wavy bristles are different in colors.

Further, in the case of the invention, the multiplex brush, the straight bristles comprise a $1^{st}$ synthetic resin and a $2^{nd}$ synthetic resin, and the $1^{st}$ wavy bristles comprise the $1^{st}$ synthetic resin and carbon, and the $2^{nd}$ wavy bristles comprise the $1^{st}$ synthetic resin and a metal.

Further, in the multiplex brush according to the present invention, the strength of the bristles is increased in the order of straight bristles, $1^{st}$ wavy bristles, and $2^{nd}$ wavy bristles.

Further, in the multiplex brush according to the present invention, the weight ratio of the $1^{st}$ synthetic resin to silicon is 1:0.3~0.5, the ratio of the $1^{st}$ synthetic resin to carbon is 1:0.1~0.2, and the weight ratio of the $1^{st}$ synthetic resin to metal is 1:0.2~0.3.

Further, in the multiplex brush according to the present invention, the metal is magnesium power.

Further, in the multiplex brush according to the present invention, the diameters of the straight bristles, the $1^{st}$ wavy bristles, and the $2^{nd}$ wavy bristles may be the same, or the diameter is reduced in the order of the straight bristles, the $1^{st}$ wavy bristles, and the $2^{nd}$ wavy bristles.

Effect of the Invention

The multiplex brush according to the present invention provides a user with a sense of beauty with bristles of different colors and is composed of three different types of bristles so that the user can visually check the state of the hair when styling. Thus, the user can more reliably recognize the difference in effect between the multiplex brush and the existing single-type bristle brush.

Also, the multiplex brush according to the present invention provides users additional gripping power with the straight bristles, the $1^{st}$ wavy bristles and the $2^{nd}$ wavy bristles that are implanted together, and provides the users with hairs of different thicknesses and conditions more ease in styling their hairs by using a brush with bristles with difference in degrees of twists and number of waves.

BRIEF DESCRIPTIONS OF THE DRAWINGS

DETAILED DISCLOSURE OF THE INVENTION

Hereinafter, embodiments of the present invention will be described in detail with reference to the accompanying drawings.

In the following description of the present invention, a detailed description of publicly known functions or configurations incorporated herein will be omitted when it may make the subject matter of the present invention rather unclear. Further, the following terms are defined considering functions in the present invention, and this may vary depending on the intention or the precedent of the user and the operator. Therefore, the definition should be based on the contents throughout this specification.

Figure 1:
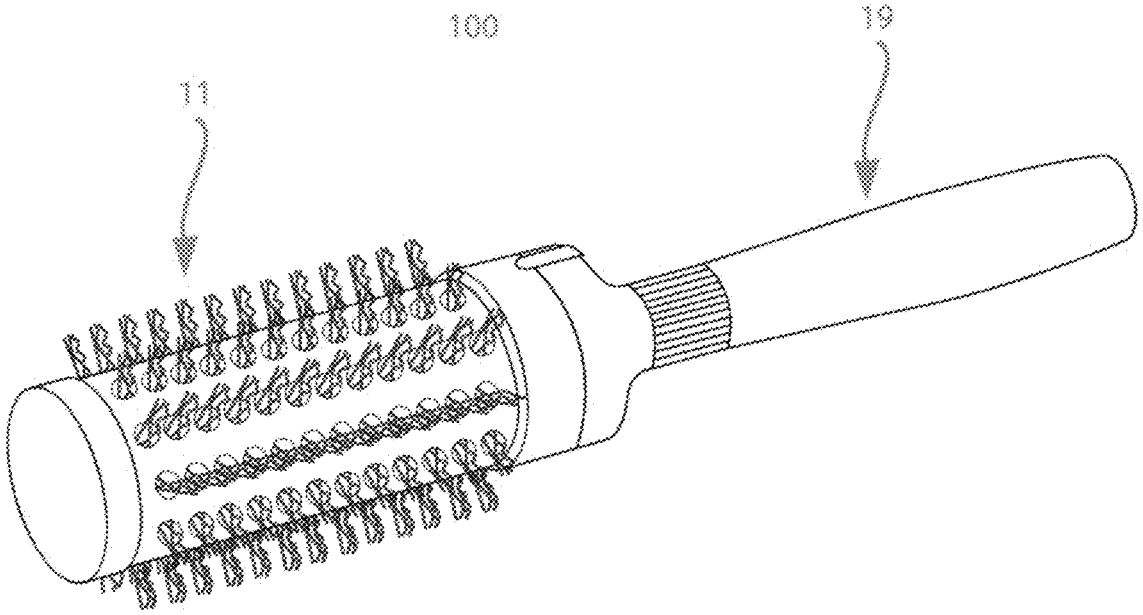
FIG. 1 is the perspective view showing an embodiment of a multiplex brush according to the present invention.
Figure 2:
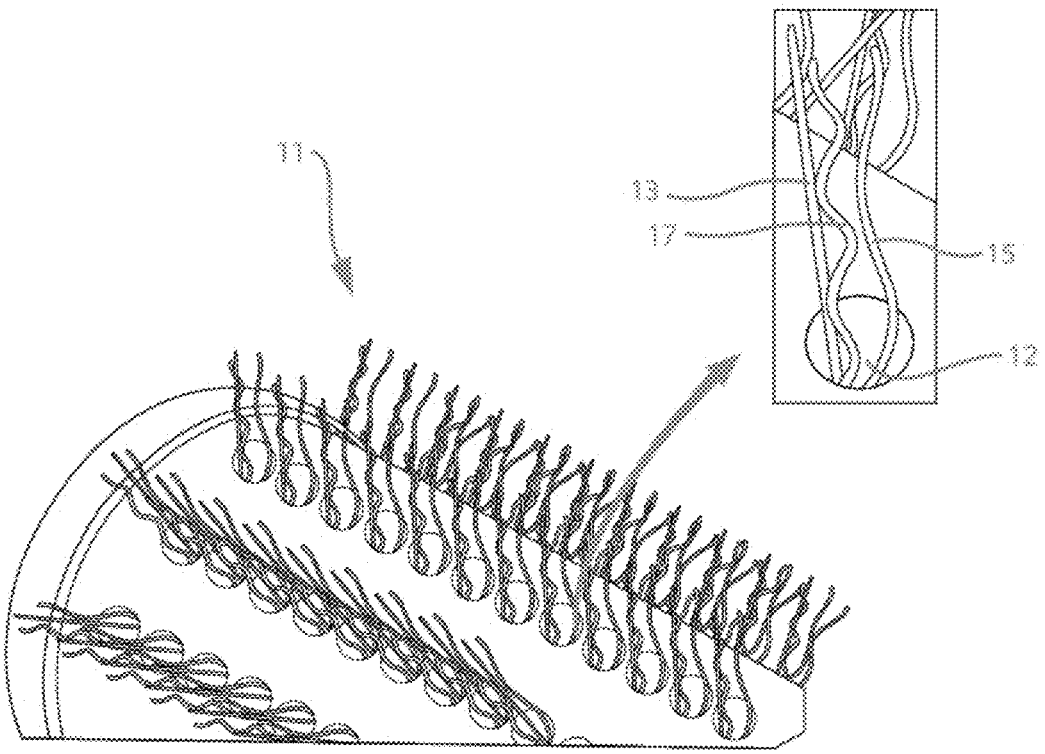
FIG. 2 is an enlarged perspective view of the brush body shown in FIG. 1.
Figure 3:
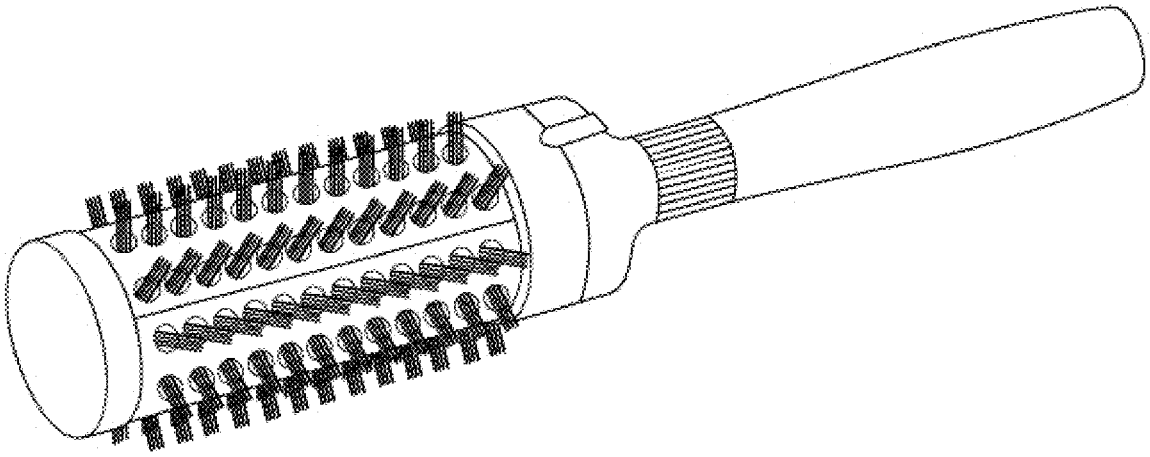
FIG. 3 is a photograph of a conventional round brush.

FIG. 1 is a perspective view showing an embodiment of a multiplex brush according to the present invention, and FIG. 2 is an enlarged view of a body part in FIG. 1.

As shown in FIG. 1 and FIG. 2, the multiplex brush (10) according to the present invention is largely composed of a cylindrical body portion (11) and a handle portion (19) to one side of the brush body portion (11).

A plurality of insertion holes (12) are formed on an outer circumferential surface of the said brush body (11).

In each insertion hole (12), three types of bristles with different structures, components, and colors are inserted together.

The said brush bristles are largely composed of straight bristles (13), $1^{st}$ wavy bristles (15), and $2^{nd}$ wavy bristles (17).

It is possible to exemplify that the said straight bristles (13), $1^{st}$ wavy bristles (15), and $2^{nd}$ wavy bristles (17) are made in different colors respectively.

For example, the said straight bristles (13) may be blue, the said $1^{st}$ wavy bristles (15) may be green, and the said $2^{nd}$ wavy bristles (17) may be red, but the colors of the bristles are not limited to those colors.

As described above, different colors of bristles provide a user the sense of aesthetics, and the user can visually check his/her hairstyle while using the brush which is composed of three different types of bristles, therefore, the user can more clearly recognize the difference between the multiplex brush and the existing single-bristle brush.

Meanwhile, the reason for planting the said straight bristles (13), $1^{st}$ wavy bristles (15), and $2^{nd}$ wavy bristles (17) is to reinforce the gripping power of the brush to grab the hair.

For example, if there are only straight bristles (13) planted in the insertion hole (12) of a brush, the brush cannot grasp hair so the hair will fall out of the brush. Another example is that styling is not easy because the hair is not curled well as the user intended when making curls or when air-drying hair by pulling the hair out of the body (11) of the round brush.

Also, even if $1^{st}$ and $2^{nd}$ wavy bristles (15, 17) are used together with a straight bristle (13), if they are planted separately in different insertion holes (12) without being planted together in the insertion holes, styling is not easy because the grip of the brush on the hair is weak.

According to the present invention, by planting the 1st and 2nd wavy bristles (15, 17) together with the said straight bristles (13), the effect of grasping the hair is improved by at least 50% compared with the conventional hairbrushes.

The said $1^{st}$ wavy bristles (15) and the $2^{nd}$ wavy bristles (17) are different in their degrees of twists as a feature.

The said $2^{nd}$ wavy bristles are formed to have a greater degree of twist or wave number (helical rotation number) than the said $1^{st}$ wavy bristles, and it is illustrated that the number of waves of the $2^{nd}$ wavy bristle (17) is 1.5 times to 3 times that of the $1^{st}$ wavy bristle (15).

As described above, by configuring the degrees of twist and wave number of the 1st wavy bristles (15) and the 2nd wavy bristles (17) differently, it is possible to keep various kinds of hair with different thicknesses and conditions in an optimal state when styling.

It is illustrated that the said straight bristle, the 1st wavy bristle (15), and the 2nd wavy bristle (17) are made of different materials.

In particular, the said straight bristle (13) may comprise a 1st synthetic resin and a 2nd synthetic resin.

It may be illustrated that the main component of the said $1^{st}$ synthetic resin is PVC and of the $2^{nd}$ synthetic resin is silicon.

The said silicone suppresses the generation of static electricity, so hair is easily removed when the hair is brushed straight down, and prevents hair from tangling when pushed or pulled with the brush.

The said 1st wavy bristle (15) may be formed by adding carbon to the first synthetic resin. The said carbon acts as a filler to provide strength and elasticity and to prevent static electricity.

The $2^{nd}$ wavy bristle (17) may be made by adding a metal to the $1^{st}$ synthetic resin, and herein illustrates that the metal is magnesium.

Different components are added to the said $1^{st}$ wavy bristle (15) and the $2^{nd}$ wavy bristle (17) so that the strength and elasticity are different from each other.

The weight ratio of the said $1^{st}$ synthetic resin and the carbon is preferably 1:0.3-0.5, the weight ratio of the said $1^{st}$ synthetic resin and the carbon is preferably 1:01-0.2, and the weight ratio of the said $1^{st}$ synthetic resin and the metal is preferably 1:0.2-0.3.

The said straight bristle (13), the $1^{st}$ wavy bristle (15) and the $2^{nd}$ wavy bristle (17) may have the same diameter as shown.

Further, although not shown, the diameters of the straight bristle, the $1^{st}$ wavy bristle, and the $2^{nd}$ wavy bristle can be configured to be reduced in the order listed above.

In the figure, the straight bristle, the $1^{st}$ wavy bristle and the $2^{nd}$ wavy bristle are shown as being planted singularly in the respective insertion holes. However, there could be more than one bristle of a type of bristle in one insertion hole.

Hereinafter, a preferred embodiment of the multiplex brush according to the present invention will be described in detail.

Embodiment 1

A plurality of insertion holes were formed in the body portion of the cylindrical brush, and straight bristles and $1^{st}$ and $2^{nd}$ wavy bristles were planted together in each insertion hole to produce a multiplex brush of the present invention.

Straight bristle was manufactured by mixing PVC and silicon at a weight ratio of 1:0.5, the $1^{st}$ wavy bristle was manufactured by mixing PVC and carbon powder at a weight ratio of 1:0.1, and $2^{nd}$ wavy bristle was manufactured by mixing PVC and magnesium powder at a weight ratio of 1:0.3.

Sensory evaluation was carried out on 20 randomly selected panels to examine the performance of the multiplex brush of Embodiment 1.

The panel group consisted of 10 people (panel 1 group) with straight hair and 10 people (panel group 2) with perm hair.

In the sensory evaluation, each panel evaluated after brushing and pulling on the hair after gripping it at least three times.

The sensory test criteria were as follows: feeling when brushing hair (evaluation 1), feeling when pulling the hair after gripping it by rolling the ends (evaluation 2), and whether styling was done well. Numbers closer to '1' are close to 'very bad' and closer to '7' are closer to 'very good' and the averaged results are shown in Table 1 below. As for the evaluation of the occurrence of tangles and static electricity (evaluation 4 and 5), ○ (No tangle/no static electricity), Δ (Slightly tangled/slight static electricity) and X (Tangle/static electricity occurred) marks were used.

TABLE 1

| | Panel Group 1 | Panel Group 2 |
|---|---|---|
| Evaluation 1 (feeling when brushing hair) | 6.4 | 6.7 |
| Evaluation 2 (feeling when pulling the hair rolled on the brush) | 6.7 | 6.8 |
| Evaluation 3 (whether styling was done well) | 6.6 | 6.8 |
| Evaluation 4 (hair tangled) | ○ (10 persons) | ○ (9 persons), Δ (1 person) |
| Evaluation 5 (static electricity occurred) | ○ (10 persons) | ○ (10 persons) |

As shown in Table 1 above, evaluation result of all panel member in groups 1 and 2 shows that the feeling of the grip greatly improved when the hair is brushed or pulled after rolling it on the multiplex brush of the Embodiment 1, and thus it becomes easier to style the hair.

Moreover, it was confirmed that tangling or static electricity hardly occurs when using multiplex brush.

Meanwhile, although a detailed description and an attached figure of the present invention described with reference to specific embodiments, the present invention is not limited to the disclosed embodiments. In addition, various modifications, transformations, and alterations can be made by those skilled in the art without departing from the technical spirit of the present invention. Accordingly, the scope of the present invention should not be limited within the described embodiments but should be construed as comprising the following claims, as well as the equivalents to the claims of this specification.

DESCRIPTION OF SYMBOLS

100: Multiplex Brush
11: Brush body
12: Insertion hole
13: Straight bristle
15: 1st wavy bristle
17: 2nd wavy bristle
19: Brush handle

The invention claimed is:

1. A multiplex brush comprising:

a brush with a cylindrical body with multiple holes inserted with bristles, wherein in each of the multiple holes, there are straight bristle, $1^{st}$ wavy bristle in the shape of a spiral and $2^{nd}$ wavy bristle more twisted than the $1^{st}$ wavy bristles;

wherein the straight bristle includes $1^{st}$ synthetic resin and silicon;

wherein the $1^{st}$ wavy bristle includes $1^{st}$ synthetic resin and carbon; and wherein the said $2^{nd}$ wavy bristle include a $1^{st}$ synthetic resin and metal.

2. The multiplex brush according to claim 1, wherein the straight bristle, the $1^{st}$ wavy bristle and the $2^{nd}$ wavy bristle are made of different colors.

3. The multiplex brush according to claim 1, wherein the strength and elasticity of the straight bristle, the 1" wavy bristle and the $2^{nd}$ wavy bristle increase in the order of the straight bristle, the 1" wavy bristle and the $2^{nd}$ wavy bristle.

4. The multiplex brush according to claim 1, wherein the weight ratio of the 1" synthetic resin to silicon is 1:0.3~0.5; wherein the weight ratio of the 1" synthetic resin to carbon is 1:0.1~0.2; and wherein the weight ratio of the 1" synthetic resin to metal is 1:0.2~0.3.

5. The multiplex brush according to claim 4, wherein the metal is magnesium powder.

6. The multiplex brush according to claim 1, wherein diameters of the straight bristle, the 1" wavy bristle and the $2^{nd}$ wavy bristle are the same, or the diameters decrease in the order of the straight bristle, the 1" wavy bristle and the $2^{nd}$ wavy bristle.

* * * * *